US007798844B2

(12) United States Patent
Li et al.

(10) Patent No.: US 7,798,844 B2
(45) Date of Patent: Sep. 21, 2010

(54) LAMP ASSEMBLY HAVING SELF-RETAINING MEANS FOR LOCKING CABLE

(75) Inventors: Xiao-Li Li, Kunshan (CN); Ping-Sheng Su, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 61 days.

(21) Appl. No.: 12/286,395

(22) Filed: Sep. 29, 2008

(65) Prior Publication Data

US 2009/0093156 A1 Apr. 9, 2009

(30) Foreign Application Priority Data

Oct. 9, 2007 (CN) ..... 2007 2 0043548 U

(51) Int. Cl.
*H01R 13/58* (2006.01)

(52) U.S. Cl. ..... 439/460; 439/617

(58) Field of Classification Search ..... 439/617, 439/619, 460, 496, 356, 419, 699.2
See application file for complete search history.

(56) References Cited

U.S. PATENT DOCUMENTS 5,620,343 A * 4/1997 Pan ..... 439/699.2
5,707,138 A * 1/1998 Pan ..... 362/657
5,718,502 A 2/1998 Tseng
5,791,940 A * 8/1998 Chen et al. ..... 439/619
5,795,189 A * 8/1998 Liou ..... 439/602
5,820,419 A * 10/1998 Liao ..... 439/699.2
5,989,047 A * 11/1999 Huang ..... 439/252
6,083,055 A * 7/2000 Chuang ..... 439/699.2
6,183,310 B1 * 2/2001 Shu ..... 439/699.2
6,200,169 B1 * 3/2001 Tseng ..... 439/699.1
6,376,974 B1 * 4/2002 Tsai ..... 313/318.01
6,774,549 B2 * 8/2004 Tsai et al. ..... 313/318.01
6,878,015 B2 * 4/2005 Fan ..... 439/699.2
7,241,032 B2 * 7/2007 Qingbiao ..... 362/382
2008/0299817 A1 * 12/2008 Liu ..... 439/419

FOREIGN PATENT DOCUMENTS

CN 2392977 8/2000

* cited by examiner

*Primary Examiner*—T C Patel
*Assistant Examiner*—Harshad C Patel
(74) *Attorney, Agent, or Firm*—Wei Te Chung; Andrew C. Cheng; Ming Chieh Chang

(57) ABSTRACT

A lamp assembly (100) includes a lamp base (3) having a peripheral wall (31) and a rear wall (32) connecting to the peripheral wall to form a socket (30) with a front opening, with a cable passage (321) recessed forwardly from a back surface of the rear wall and communicated with the socket, a cavity (37) defined in the rear wall and further communicated with the cable passage (321), and a engaging member (371) located in a lower portion of the cavity and proximate to the cable passage; at least a cable (4) inserted into the cable passage, with the engaging member (371) deformed to lock therein so as to prevent the cable sliding out of the cable passage; a lamp bulb (1) partially received in the socket of the base, with a pair of legs (13) thereof extending into the socket and contacting conductors of the cable.

15 Claims, 7 Drawing Sheets

LAMP ASSEMBLY HAVING SELF-RETAINING MEANS FOR LOCKING CABLE

FIELD OF THE INVENTION

The present invention generally relates to a lamp assembly, and more particularly to a LED (light emitting diode) lamp assembly which has wires securely attached to a lamp base by self-retaining means, without additional auxiliary devices.

DESCRIPTION OF PRIOR ART

In Christmas or other celebrated Festivals, lamp assemblies are widely used for decoration so as to create amicable atmosphere. The previous (and existing) lamp assembly mainly uses incandescent lamp, which consumes great power energy. LED lamp is newly emerged high effective illuminate device, having some advantages, such as lower profile, little energy consumption and long life span, etc.

CN Pat. No. 2392977 issued on Aug. 23, 2000 to Tseng discloses a decorative lamp for festive occasions. The decorative lamp includes a lamp bulb, a lamp holder, a lamp base, two wires and two slim metal sheets. The lamp bulb is retained with the lamp holder, with pair of electrodes thereof extending through an peripheral portion of the lamp holder and accessible from outside. The lamp base defines a hollow portion therein, and the slim metal sheets are coupled to the two wires and securely attached to an inside wall of the lamp base. The lamp bulb together with the lamp holder are assembled to the lamp base, with the pair of electrodes contacting the pair of conductive pads, respectively. However, as the aforementioned lamp is relative complicated and laborious, which may not be manufactured easily and further increase cost.

Hence, an improved lamp assembly is highly desired to overcome the aforementioned problems.

SUMMARY OF THE INVENTION

Accordingly, an object of the present invention is to provide a lamp assembly which may be manufactured easily and lower cost.

In order to achieve the object set forth, a lamp assembly in accordance with the present invention comprises a lamp base defining a socket in a front portion thereof and a cable passage in a rear portion thereof, said cable passage further communicated with the socket, a cavity recessed inwardly from an outer peripheral of the rear portion of the lamp base and further communicated with the cable passage, and an engaging member located in a lower portion of the cavity and proximate to the cable passage; at least a cable inserted into the cable passage, with the engaging member deformed to lock therein so as to prevent the cable sliding out of the cable passage; and a lamp bulb partially received in the socket of the base, with a pair of legs thereof extending into the socket and contacting conductors of the cable.

Other objects, advantages and novel features of the invention will become more apparent from the following detailed description when taken in conjunction with the accompanying drawings.

DETAILED DESCRIPTION OF PREFERRED EMBODIMENTS

Figure 1:
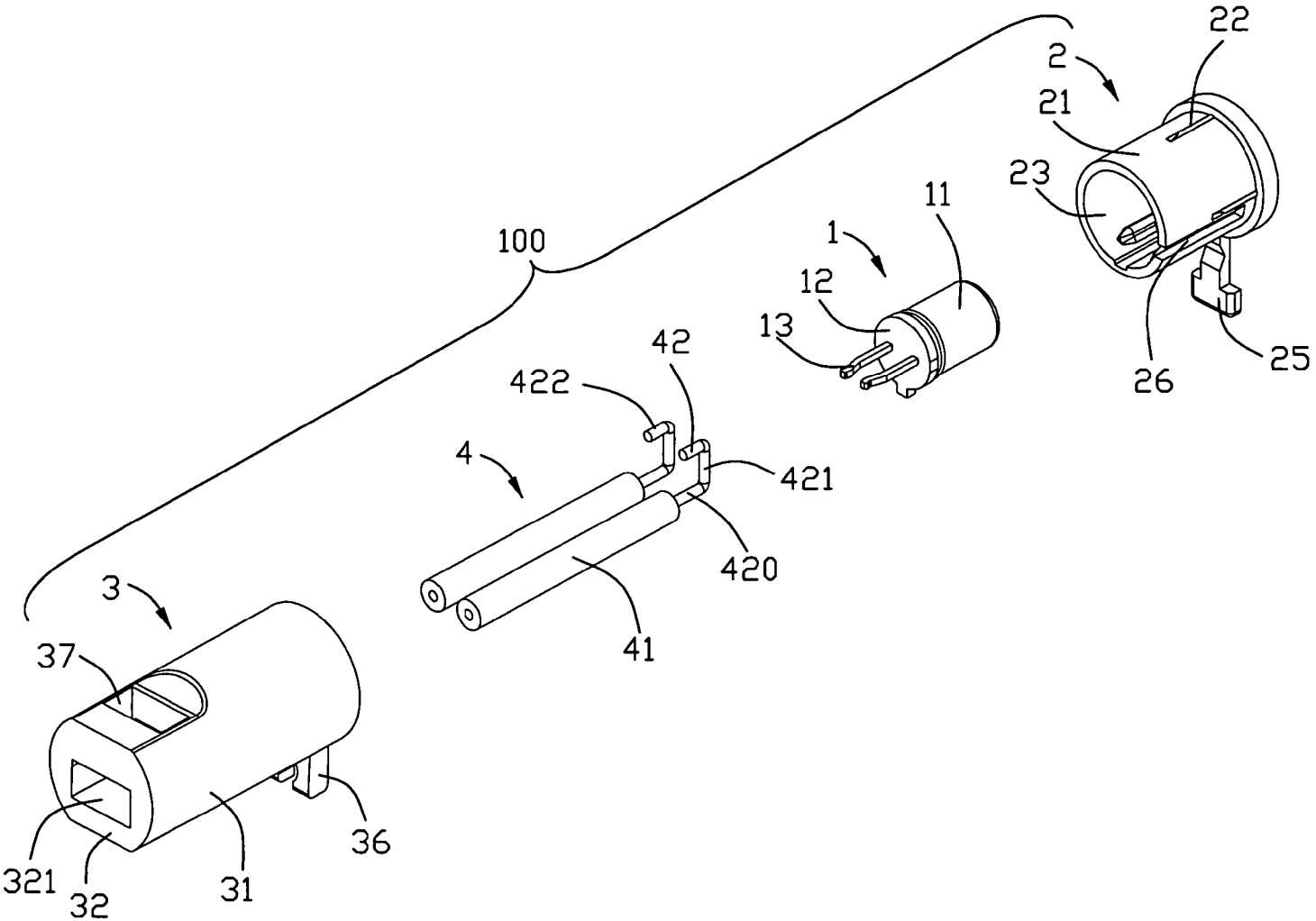
FIG. 1 is an exploded, perspective view of a lamp assembly in accordance with the present invention.
Figure 2:
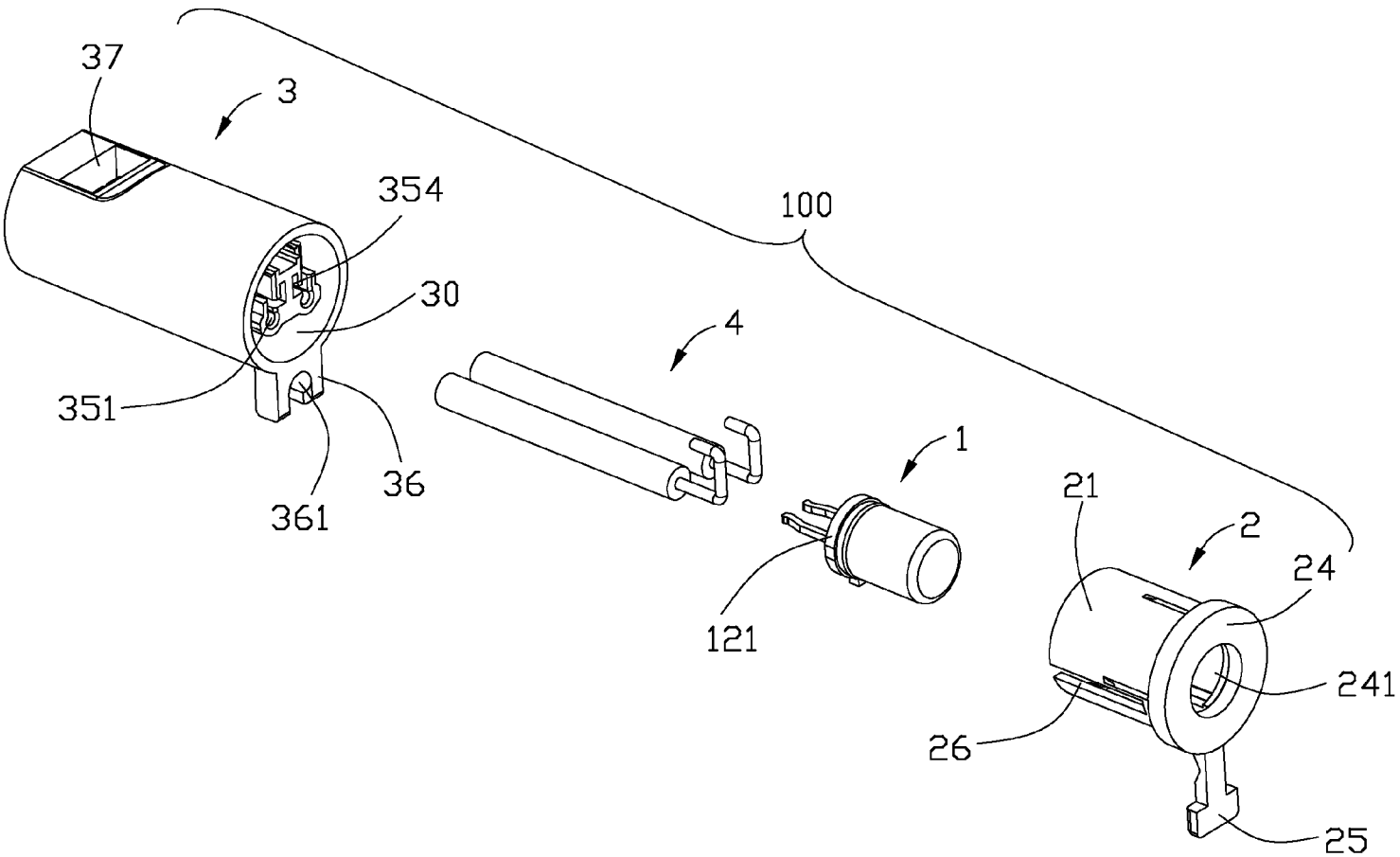
FIG. 2 is similar to FIG. 1, but viewed from another aspect.

Reference will now be made in detail to the preferred embodiment of the present invention.

Referring to FIGS. 1-7, a lamp assembly 100 in accordance with the present invention comprises a lamp bulb 1, a lamp holder 2, a lamp base 3 and a pair of cables 4.

The lamp bulb 1 utilizes LED (Light Emitting Diode) as light source, but other light source, such as incandescence light is available. The lamp bulb 1 includes a lens body 11 with a LED chip (not shown) therein, a substrate 12 for supporting the lens body 11, and a pair of legs 13 connecting the lens body 11 and extending outside through the substrate 12. The substrate 12 further has a circular-shaped flange 121 which is arranged proximate to a back edge of the lens body 11.

The lamp holder 2 has body portion 21 enclosing a hollow portion 23 therein and a lid 24 formed at a front end of the body portion 21. The body portion 21 is circular-shaped view along front-to-back direction, however, in alternative embodiments, other different shapes, such as rectangular shape, elliptic shape, etc. is available. A number of ribs 22 are formed on a peripheral portion of the body portion 21 and extend along an axial direction. A lengthwise slot 26 is defined in the body portion 21 and further communicate with the hollow portion 23. The lid 24 further defines an outlet 241 in a central portion thereof. The outlet 241 has substantially same cross-section as that of the lens 11, thus, the LED lamp 1 is retained in the hollow portion 23 of the lamp holder 2, with the lens 11 of the LED lamp 1 protruding outside through the outlet 241 of the lid 24. A T-shaped clasp 25 is equipped at a lateral side of the lid 24. A number of protruding portions 27 are formed on an inner surface of the body portion 21 and extend along the axial direction.

The lamp base 3 is a one-piece structure (unitarily formed body) which includes a cylindrical peripheral wall 31 and rear wall 32 connecting to the peripheral wall 31 to define a socket 30 with a front opening (not numbered). A cable passage 321 is recessed inwardly from an outer surface of the rear wall 32 and communicates with the socket 30. A first post 35 and a second post 350 are disposed opposite to one another and extend forwardly from an inner surface of the rear wall 32. The first post 35 is connected to an inner surface of the cylindrical peripheral wall 31, with the second post 350 is discrete from the inner surface of the cylindrical peripheral wall 31. When the lamp holder 2 is inserted into the socket 30 of the lamp base 3, the first post 35 slides along the slot 26 of the body portion 21, until they are fully mated, while the second post 350 relies against an inner surface of the lamp holder 2, and such configuration may achieve anti-mismating effect.

Figure 3:
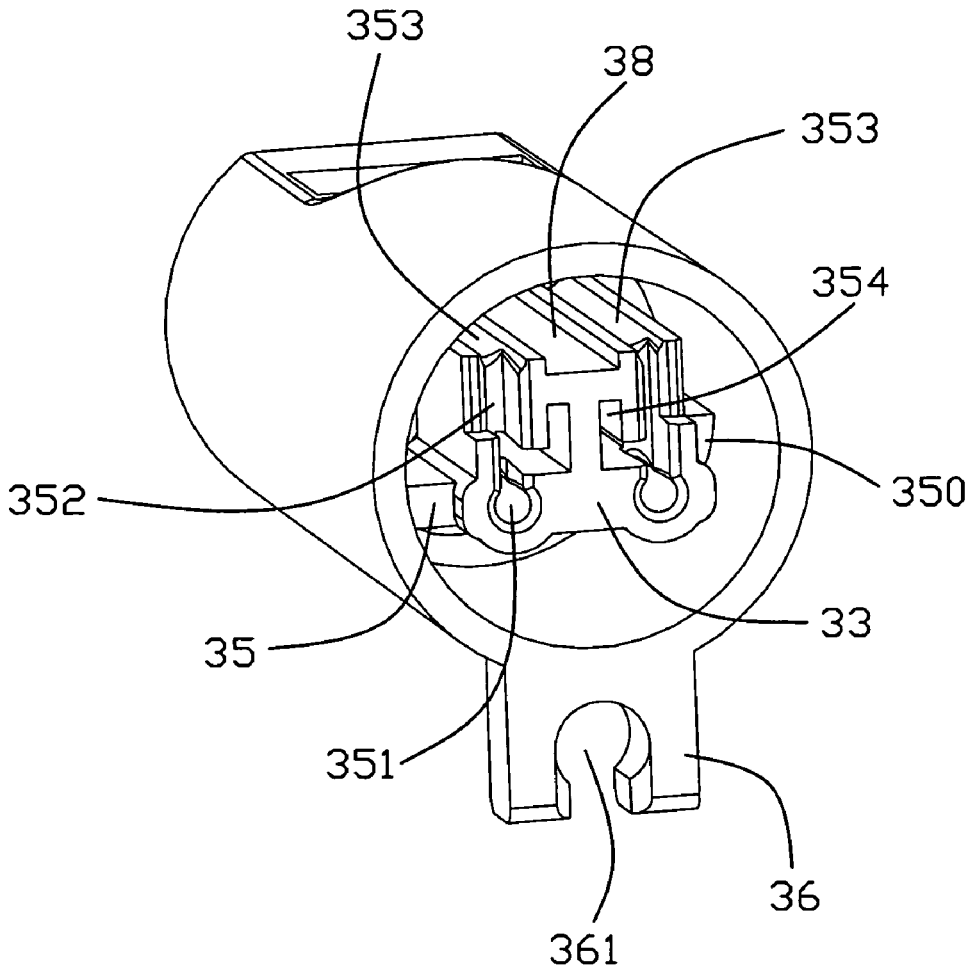
FIG. 3 is an enlarged view of a lamp base of the lamp assembly.
Figure 4:
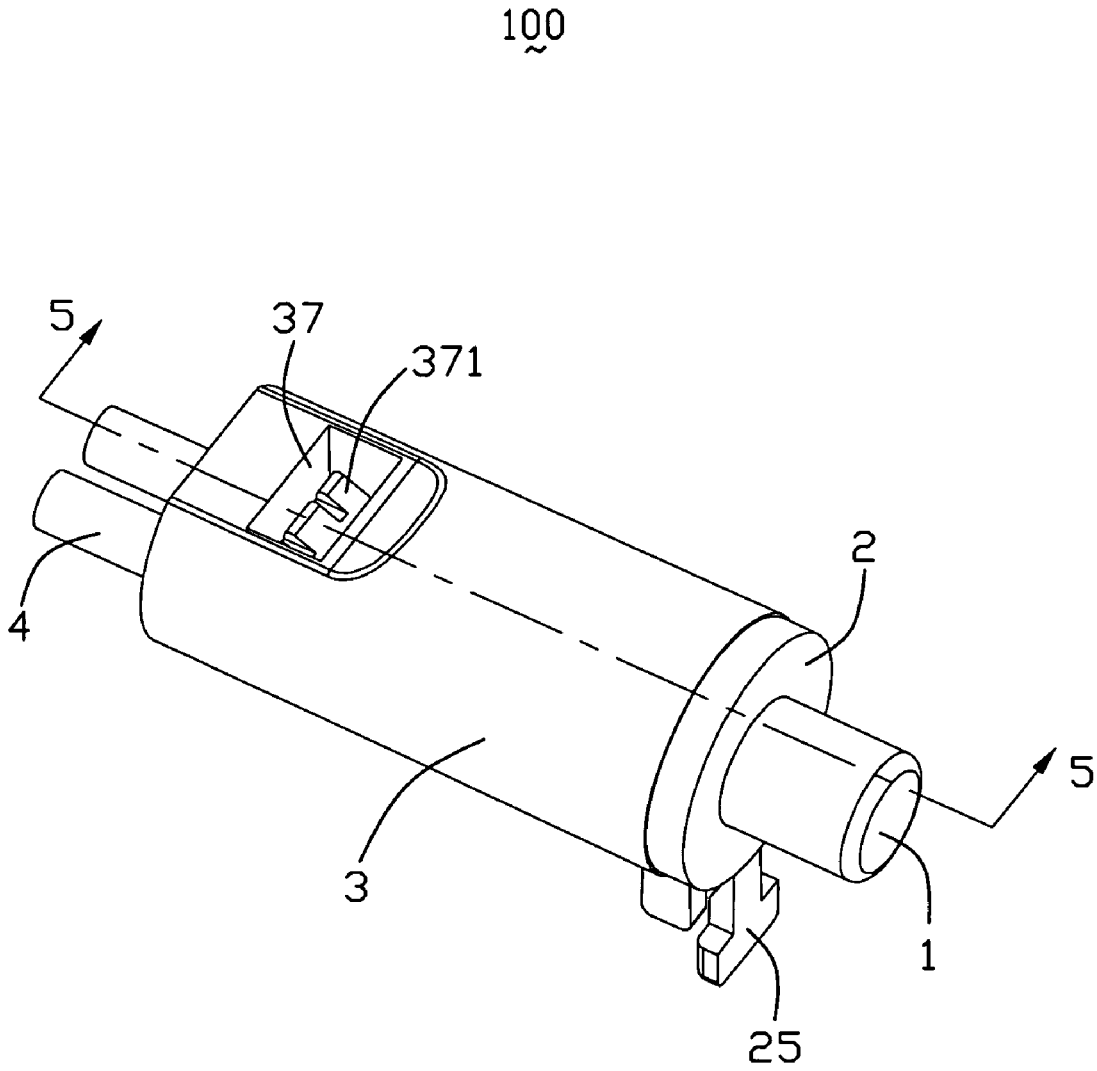
FIG. 4 is assembled, perspective view of the lamp assembly.
Figure 5:
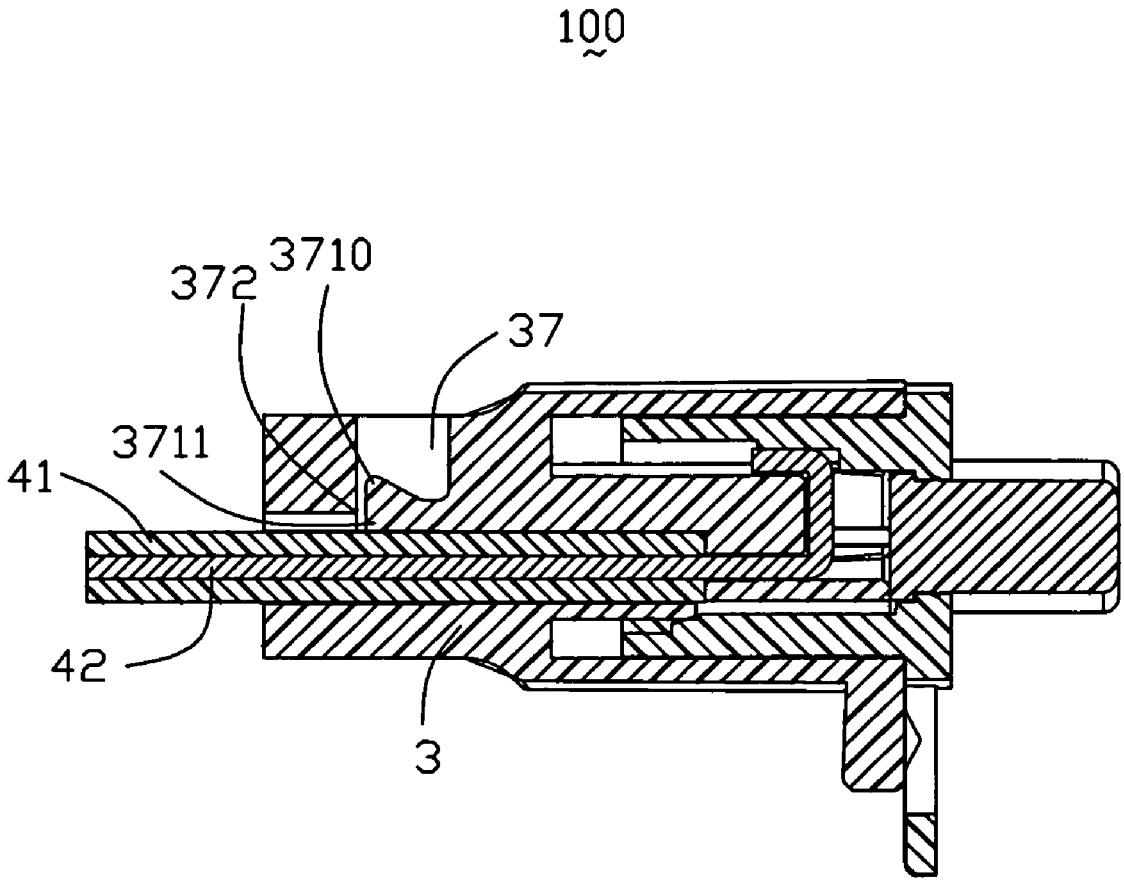
FIG. 5 is a cross-section view of FIG. 4 taken along line 5-5.
Figure 6:
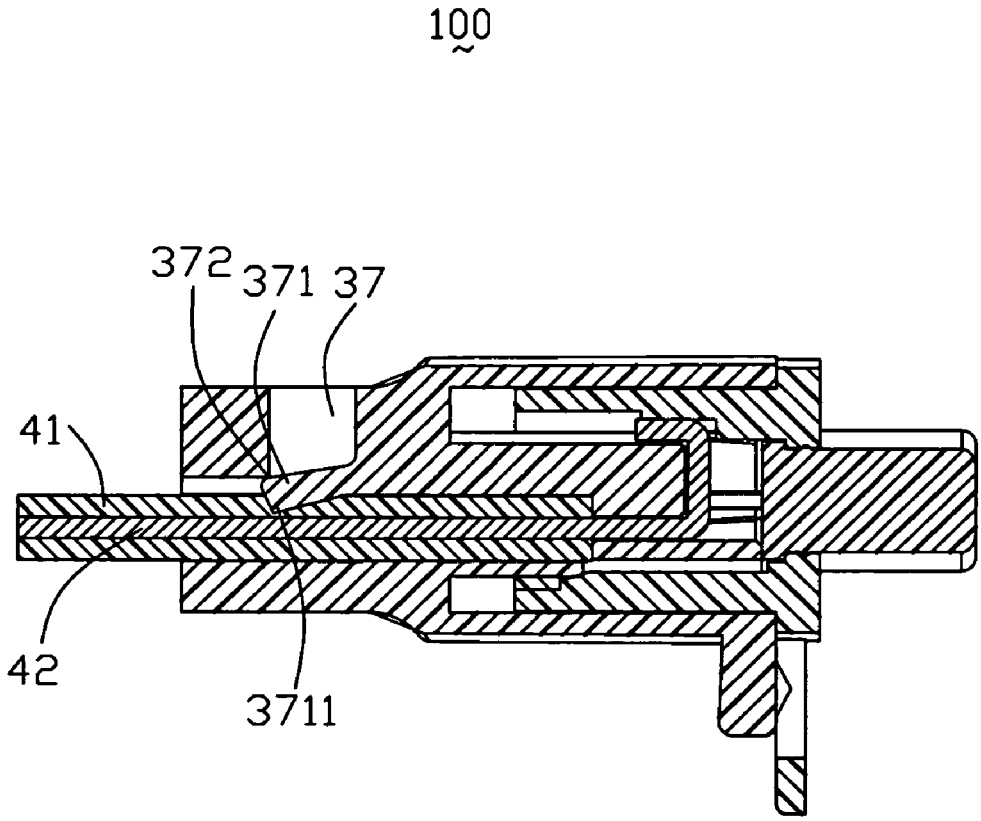
FIG. 6 is a view similar to FIG. 5, showing engaging member clipping against cables.
Figure 7:
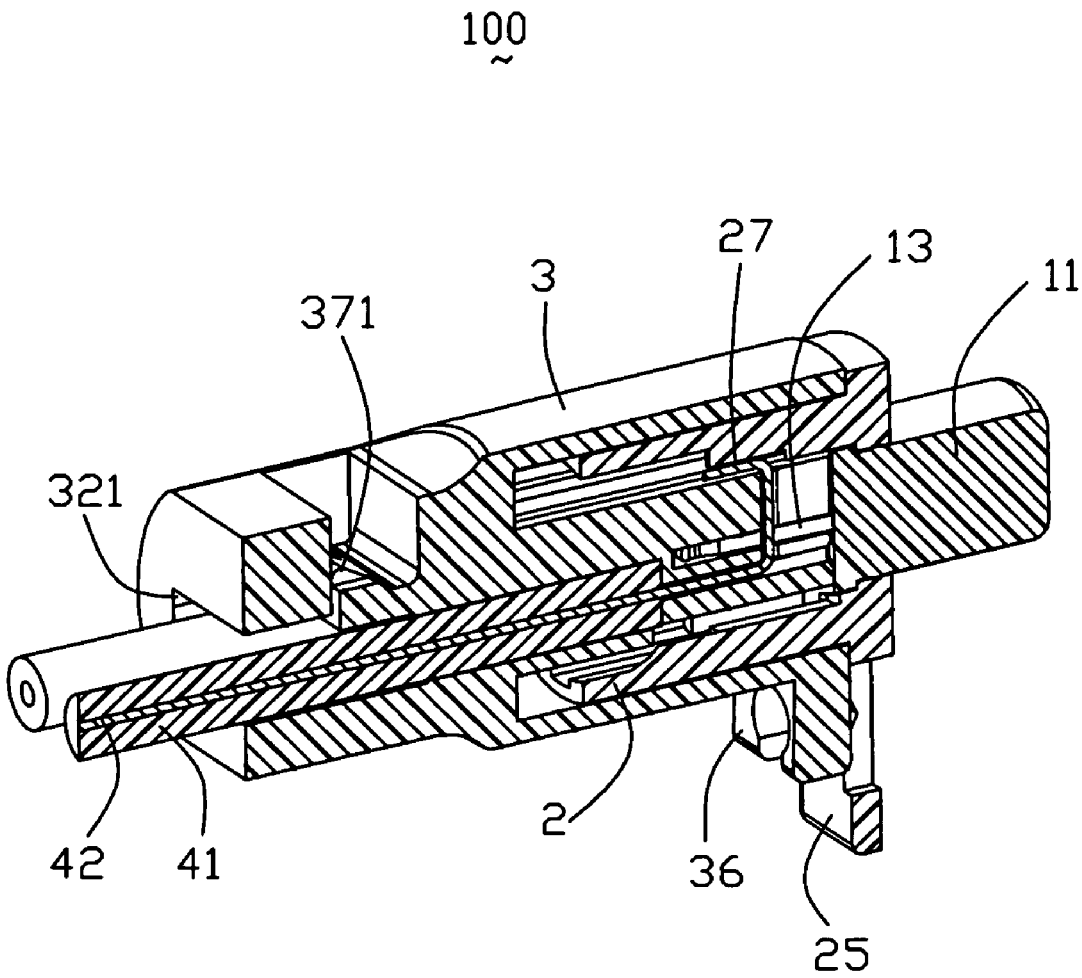
FIG. 7 is a cross-section view of FIG. 4 taken along line 5-5, but viewed from another direction.

Please particularly referring to FIG. 3, a mounting portion 33 is accommodated in the front of the sock 30 and disposed between the first and second posts 35, 350. The mounting portion 33 has two passageways 351 defined in lateral sides of a lower portion thereof and further communicate with the cable passage 321. A pair of first grooves 352 are recessed inwardly from a front surface of the lateral sides of an upper portion of the mounting portion 33 and orthogonal with the passageways 351. A pair of second grooves 353 are recessed downwardly from a top surface of the upper portion and substantially perpendicular and joining to the first grooves 352. A pair of slots 354 extend inwardly from a front face of a center section 38 of the mounting portion 33, and a lower portion of each slot 354 further communicates with corresponding first groove 352. An attached member 36 is arranged at a lateral portion of a front segment of the peripheral wall 31, with a Ω-shaped cavity 361 defined therein.

A cavity 37 is recessed downwardly from an outer side (top surface) of a rear portion of the cylindrical peripheral wall 31. A cantilevered and deformable engaging member 371 is arranged in a lower section of the cavity 37 and further adjacent to the cable passage 321. The engaging member 371 has a free end (not numbered) proximate to a corner/abutment portion 372 of an inner side (not numbered) of the rear wall 32.

Each of the cables 4 has at least a conductor 42 and a jacket 41 shielding the conductors 42. Partial of the jacket 41 of a front section of the cable 4 is removed, with the conductor 42 exposed outside. The unshielded conductor 42 is configured to be hook-shaped, including a first horizontal segment 420 extending forwardly from an interior of the cable 4, a vertical segment 421 extending upwardly from a front end of the first horizontal segment 420 and a second horizontal segment 422 parallel to the first horizontal segment 420 and extending rearwardly from a top section of the vertical segment 421.

When assemble, the cables 4 are inserted into the cable passage 321 of the lamp base 3 and the conductors 42 are bent to hook the mounting portion 33, with the first horizontal segments 420 received in the two passageways 351, the vertical segments 421 mounted to the first grooves 352 and the second horizontal segments 422 mounted to the second grooves 353. The engaging member 371 is pressed inwardly from an exterior of the lamp base (insulative housing) via the cavity 37 thereon, with a lower tip 3711 of the free end thereof pressing onto the jackets 41 of the cables 4, while an upper tip 3710 slides into the cable passage 321 and is inhibited by the corner/abutment portion 372 to prevent it retracting. Thus, the cables 4 are secured to the lamp base 3. Secondly, the lamp bulb 1 is assembled to the lamp base 3, with legs 13 inserted into the slots 354 of the mounting portion 33 and contacting the vertical segments 421 of the conductors 42 to form electrically connection therebetween. Thirdly, the lamp holder 2 is assembled to the lamp base 3, with the body portion 21 thereof inserted into the socket 30, the protruding portions 27 of the body portion 21 pressing onto the second horizontal segments 422 of the conductors 42. The ribs 22 of the peripheral portion of the body portion 21 may increase combination between the lamp holder 2 and the lamp base 3. Thus, the conductor 42 is reliably sandwiched between the lamp holder 2 and mounting portion 33. Fourthly, the clasp 25 latches with the attached member 36 to make the LED lamp 1, the lamp holder 2, the lamp base 3 coupled together more reliably.

The lamp base 3 can be coupled to the cables 4 by retention structure itself, without other auxiliary means, such as conductive pads. Therefore, the lamp assembly 100 may be manufactured easily and the cost is cut down.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A lamp assembly, comprising:

a lamp base defining a socket in a front portion thereof and a cable passage in a rear portion thereof, said cable passage further communicated with the socket, a cavity recessed inwardly from an outer peripheral of the rear portion of the lamp base and further communicated with the cable passage, and an engaging member located in a lower portion of the cavity and proximate to the cable passage;

at least a cable inserted into the cable passage, with the engaging member deformed to lock therein so as to prevent the cable sliding out of the cable passage; and a lamp bulb partially received in the socket of the base, with a pair of legs thereof extending into the socket and contacting conductors of the cable.

2. The lamp assembly as recited in claim 1, wherein the engaging member is cantilevered in the cavity of the rear wall.

3. The lamp assembly as recited in claim 2, wherein the engaging member has a free end with an upper tip and a lower tip.

4. The lamp assembly as recited in claim 3, wherein the lower tip is pressed onto jacket of the cable, and the upper tip is against inner side of the rear wall.

5. The lamp assembly as recited in claim 1, wherein a mounting portion is arranged in the front of the socket.

6. The lamp assembly as recited in claim 5, wherein the mounting portion defines a pair of passageways in lateral sides thereof, with conductors of the cable extending therein.

7. The lamp assembly as recited in claim 6, wherein a pair of slots recessed inwardly from a front surface of a center section of the mounting portion and further in communication to the pair of passageways.

8. The lamp assembly as recited in claim 7, wherein the legs of the bulb are inserted into the pair of slots and further formed electrically connection with the conductors.

9. The lamp assembly as recited in claim 5, wherein a lamp holder with a body portion enclosing a hollow portion to partially retain the lamp bulb therein.

10. The lamp assembly as recited in claim 9, wherein the lamp holder further has a lid with a outlet to allow the lamp bulb to extend outside therethrough.

11. The lamp assembly as recited in claim 10, wherein a clasp is formed at a lateral portion of the lid of the lamp holder, wherein an attached member with a cavity is arranged at a lateral portion of the lamp base to latch with the clasp.

12. The lamp assembly as recited in claim 11, wherein a post is arranged aside of the mounting portion and connected to an inner surface of the lamp base.

13. The lamp assembly as recited in claim 12, wherein the body portion of the lamp holder defines a lengthwise slot receiving the post.

14. The lamp assembly as recited in claim 5, wherein a lamp holder has a hollowed body portion sandwiched between the lamp base and the mounting portion.

15. The lamp assembly as recited in claim 14, wherein a number of ribs are formed on a peripheral portion of the body portion and extend along an axial direction.

* * * * *